US010839661B2

(12) United States Patent
Eck

(10) Patent No.: US 10,839,661 B2
(45) Date of Patent: Nov. 17, 2020

(54) AUXILIARY DETECTOR BASE FOR PROVIDING ADDITIONAL FUNCTIONALITY TO A SMOKE DETECTOR OR OTHER DETECTOR

(71) Applicant: Microchip Technology Incorporated, Chandler, AZ (US)

(72) Inventor: Arthur B. Eck, Gilbert, AZ (US)

(73) Assignee: MICROCHIP TECHNOLOGY INCORPORATED, Chandler, AZ (US)

( * ) Notice: Subject to any disclaimer, the term of this patent is extended or adjusted under 35 U.S.C. 154(b) by 11 days.

(21) Appl. No.: 16/150,584

(22) Filed: Oct. 3, 2018

(65) Prior Publication Data

US 2019/0114891 A1 Apr. 18, 2019

Related U.S. Application Data

(60) Provisional application No. 62/572,839, filed on Oct. 16, 2017.

(51) Int. Cl.
*G08B 17/113* (2006.01)
*G08B 17/06* (2006.01)
(Continued)

(52) U.S. Cl.
CPC ..... *G08B 17/113* (2013.01); *G08B 17/06* (2013.01); *G08B 17/10* (2013.01); *G08B 7/066* (2013.01)

(58) Field of Classification Search
CPC ..... G08B 17/113; G08B 17/00; G08B 17/06; G08B 17/10; G08B 7/066
See application file for complete search history.

(56) References Cited

U.S. PATENT DOCUMENTS 5,745,040 A * 4/1998 Loughridge ..... G08B 1/08 340/584
7,616,126 B2 * 11/2009 Kadwell ..... G08B 17/107 340/628

(Continued)

FOREIGN PATENT DOCUMENTS

WO 2011/050269 A1 4/2011 ..... G08B 17/10
WO 2015/110810 A1 7/2015 ..... G08B 17/00

OTHER PUBLICATIONS

International Search Report and Written Opinion, Application No. PCT/US2018/054293, 14 pages, dated Jan. 2, 2019.

*Primary Examiner* — Mohamed Barakat
(74) *Attorney, Agent, or Firm* — Slayden Grubert Beard PLLC

(57) ABSTRACT

A detector base device may provide auxiliary functionality to a smoke detector or other detector device. The detector base device may be distinct and separate from the smoke detector, and configured for physical mounting between the smoke detector and a junction box or other conventional mounting interface configured for direct mounting of the smoke detector (in a conventional mounting arrangement without the detector base device). Thus, the detector base device may include a first mounting structure (e.g., on a top side) for mounting the detector base device to the junction box or other conventional detector mounting interface, and a second mounting structure (e.g., at a bottom side) for mounting the smoke detector to the detector based device. The detector base device may include an auxiliary function system configured to provide auxiliary audio, communication, sensor-based detection, and/or data recording functions, and may also including a battery backup for line power outage.

20 Claims, 7 Drawing Sheets

(51) Int. Cl.
*G08B 17/10* (2006.01)
*G08B 7/06* (2006.01)

(56) References Cited

U.S. PATENT DOCUMENTS

| | | | | |
|---|---|---|---|---|
| 9,520,042 | B2 | 12/2016 | Eck | |
| 2004/0201565 | A1* | 10/2004 | Cunningham | G09F 13/04 345/102 |
| 2005/0253709 | A1* | 11/2005 | Baker | G08B 25/009 340/539.26 |
| 2008/0224848 | A1* | 9/2008 | Meyer | G08B 17/10 340/517 |
| 2011/0043367 | A1* | 2/2011 | Becker | G08B 25/06 340/577 |
| 2011/0210854 | A1* | 9/2011 | Kelly | G08B 17/00 340/584 |
| 2015/0077737 | A1* | 3/2015 | Belinsky | G01N 21/53 356/51 |
| 2015/0181741 | A1* | 6/2015 | Stagg | G08B 17/10 361/731 |
| 2017/0236402 | A1 | 8/2017 | Mcgee | |
| 2019/0180735 | A1* | 6/2019 | McElhaney | G10L 15/08 |

* cited by examiner

AUXILIARY DETECTOR BASE FOR PROVIDING ADDITIONAL FUNCTIONALITY TO A SMOKE DETECTOR OR OTHER DETECTOR

RELATED PATENT APPLICATION

This application claims priority to commonly owned U.S. Provisional Patent Application No. 62/572,839 filed Oct. 16, 2017, the entire contents of which are hereby incorporated by reference for all purposes.

TECHNICAL FIELD

The present disclosure relates to consumer electronics, home automation, and alarm systems, and, more particularly, to an auxiliary base for connection to a detector (e.g., smoke detector), e.g., for providing enhanced functionality (e.g., audio, communications, or sensing capabilities) to the detector.

BACKGROUND

Many municipalities, states and countries may require smoke alarms through building codes, e.g., 2012 International Residential Code (IRC), in each sleeping room, outside each separate sleeping area in the immediate vicinity of the bedrooms, and on each additional story of the dwelling, including basements (IRC 314.3). Smoke detectors may be powered from the AC line and may have a battery backup. A single backup battery may be provided for a plurality of smoke detectors, e.g., in industrial installations where the one main battery backup may be used instead of a backup battery at each smoke alarm.

Where more than one smoke alarm is required to be installed within an individual dwelling unit in accordance with IRC Section R314.3, the smoke alarm devices shall be interconnected in such a manner that the actuation of one smoke alarm will activate all of the smoke alarms in the individual unit (IRC 314.5). The building code required smoke alarms silently sit in place, hopefully never to be needed.

U.S. Pat. No. 9,520,042, commonly owned by the assignee of the present application and incorporated herein by reference in its entirety, includes embodiments that may be applied to incorporating a carbon monoxide or smoke detector in such devices as intercoms, smart home voice control devices, door bells, blue tooth speakers etc. However, such application must pass agency review for technical implementations to be used. The relevant agency typically reviews technical requirements for various aspects of reliability and safety. The relevant agency may depend on the country at issue. For example, the relevant agency in the U.S. may be UL and ETL; the agency in the U.K. may be BSI; the agency in France may be NF; and the agency in Germany may be VdS.

SUMMARY

Embodiments of the present invention include a detector base for a detector, and detector assemblies including a detector assembled to a detector base. Such detector assemblies may provide physical and/or other environmental detection such as smoke, movement, heat, proximity, carbon monoxide, or other phenomena.

Some embodiments of the present invention include a detector base that provides additional functionality (e.g., audio capabilities, communication capabilities, and/or auxiliary sensing capabilities) that piggy-backs onto the detector as a separate, connectable component, e.g., as an add-on configured for connection to existing detectors. In some embodiments, the detector base is a separate device (from the detector) configured for a plug-in type connection to an existing detector, and thus as a separate device the detector base may not be subject to agency review requirements that may apply to the detector.

In general, it would not have been obvious to develop a separate plug-in device to provide audio or communications functionality to a detector, as opposed to developing an integrated detector/audio system, as the separate plug-in device would presumably have additional costs related its own case, speaker, power supply, etc. However, the inventor has discovered that by providing the audio functionality in a separate device from the detector, e.g., in a detector base configured for plug-in connection to the detector, the separate audio device (e.g., plug-in detector base) may avoid agency review requirements that may apply to the detector, which may thus justify development of a separate audio device.

BRIEF DESCRIPTION OF THE DRAWINGS

A more complete understanding of the present disclosure may be acquired by referring to the following description taken in conjunction with the accompanying drawings wherein.

DETAILED DESCRIPTION

Figure 1A:
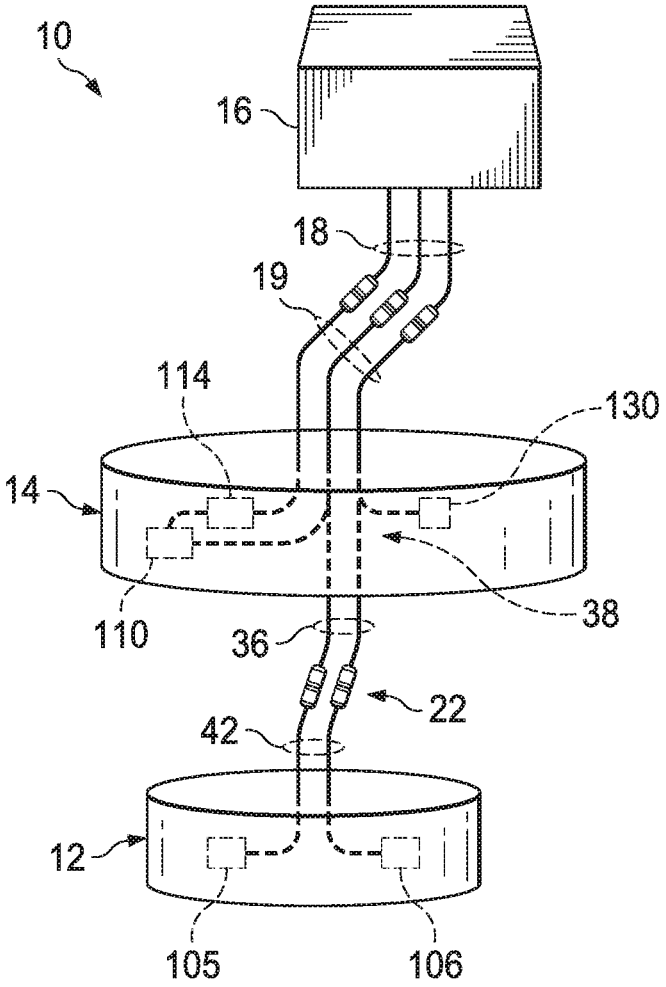
FIG. 1A shows an assembly drawing an example detector assembly including a detector (e.g., smoke detector) and a detector base (e.g., for providing enhanced audio and/or control functionality for the detector), according to an example embodiment of the present invention.

Some embodiments provide a detector assembly that provides both detection (e.g., smoke detection, etc.) and audio capabilities. Some embodiments of the present invention include a detector base that provides audio functionality, control functionality, additional sensing functionality, and/or other functionality that piggy-backs onto a detector (e.g., smoke detector) as a separate, connectable component, e.g., as an add-on configured for connection to an existing detector. Thus, in some embodiments the detector base is a separate device configured for a plug-in type connection to an existing detector, and thus as a separate device the detector base may not be subject to agency review requirements that may apply to the detector.

Although this disclosure mainly refers to smoke detection, the detector may be configured for detection of carbon monoxide (CO), carbon dioxide (CO2), explosive gas, hazardous gas, heat, and/or any other substance or environmental condition.

In some embodiments or instances, the detector assembly (including a detector assembled to a separate detector base) may replace existing smoke detector devices to provide both smoke detection (and/or other types of sensor-based detection) and audio features at a common location. In other embodiments or instances, a detector base may be assembled as an add-on or auxiliary component to an existing detector instance or model, to add further functionality to the existing detector.

According to many modern building codes, smoke detector outlets must provide electrical power and a networked connection for simultaneous smoke alarm actuation in a building if the smoke alarm devices are not approved for wireless actuation. Embodiments of the present invention provide a detector base that includes audio electronics (e.g., speakers, amplifiers, etc.) configured to be powered by the power source connection provided at each detector location. The detector is assembled to the detector base to provide an electrical connection to provide power from the power source to the detector via the detector base. A smoke alarm network connection, if present, may also be used to carry audio signal content, either digital or analog, or a combination thereof, e.g., Ethernet local area network (LAN) to the detector base and/or to the detector via connection to the detector base.

Thus, some embodiments provide a smoke detector assembly including a detector (e.g., an existing detector) connected to an add-on or auxiliary detector base that provides enhanced audio and communications capabilities that allow audio content to be provided at the location of each smoke detector assembly. This audio content may include music, intercom, doorbell actuation, radio programs, etc. Thus, the detector base may include one or more speakers, amplifiers, and/or any other audio electronics. In some embodiments, a plurality of detector bases connected in a network networked speakers for distribution of music, intercom, telephone, and/or doorbell annunciation. The detector base may also include a microphone, e.g., for monitoring and two way communications with other smoke detector assemblies or with a doorbell intercom system, for controlling lights in an area of the smoke detector assembly with voice commands, and/or to provide speakerphone answering and communications capabilities, for example. Audio content and control may be provided to each detector base by a software program application running on a personal computer, tablet computer, or smart phone communicatively connected to the respective detector base. Each detector base may also be controlled remotely by any handheld or other control device, e.g., via RF, Bluetooth or infrared communications, for example.

In some embodiments, audio signal content and/or smoke alarm notification actuation may be provided to each detector assembly by wireless transmission, e.g., wireless LAN (WLAN), WiFi, Zigbee, etc. Thus, each detector base may include relevant electronics for wireless communications (e.g., antenna, receiver, transmitter, communication control electronics, etc.) to and/or from the respective detector assembly. Different audio content may be provided at each detector assembly location and may be controlled through a central control point using a software program application (App) with, for example but not limited to, a personal computer, tablet computer, smart cell phone, iPod, etc.

In some embodiments, each detector base may also include a memory device port or connection interface for receiving a removable memory device, e.g., a solid state memory stick, e.g., USB thumb drive; secure digital (SD) drive, etc. The removable memory device may remain in place with its associated detector base or may down load its contents into a memory provided in the detector base and then be removed. The removable memory device may store preprogrammed announcements when a smoke alarm occurs and/or preprogrammed music or other audio content, e.g., white noise, lullaby's, poetry, exercise routines, etc., for playing through speaker(s) provided in the detector base at requested and/or preprogrammed times.

In some embodiments, a detector system base may have paired, coded, hand held control transmitters, e.g., infra-red (IR), Bluetooth, etc., located in the area of each smoke detector assembly to allow a person to select audio content, e.g., music, radio, intercom, speaker phone, etc., in the relevant area (e.g., bedroom, kitchen, den, etc.), to respond to an intercom query, and/or converse with a person interfacing with a doorbell system. Two or more detector assemblies having audio capabilities may be configured to monitor at least one area, one used for audio pickup in and the other for audio monitoring of, e.g., a baby nursery, small child play area, pool area, etc.

Each smoke detector assembly having audio capabilities may be used to output a security alert upon detection of a home break-in, provide audio evacuation instructions upon a smoke alert, control air conditioning equipment, e.g., having internal sensor(s) for temperature and/or relative humidity (RH); and/or turn on and off lights in an area of the detector assembly through voice commands.

In some embodiments, the detector base may include one or more additional sensors to provide auxiliary sensing functionality. For example, the detector base may include a smoke sensor, a CO sensor, a $CO_2$ sensor, a sensor for sensing other gas(es), a heat sensor, a humidity sensor, a motion sensor, or any other type(s) of sensor(s).

In some embodiments, the detector base may include a power supply system configured to supply power to the detector base and also to the detector, e.g., as a redundant power source for the detector. For example, the detector base power supply system may include a battery for supplying back-up power to the detector base and/or to detector, and in some embodiments may include an invertor to convert power from the on-board battery to A/C, and supply the A/C power to the detector, e.g., for an A/C-powered detector.

Referring now to the drawing, the details of specific example embodiments are schematically illustrated. Like elements in the drawings will be represented by like numbers, and similar elements will be represented by like numbers with a different lower case letter suffix.

FIG. 1A shows an assembly drawing an example detector assembly 10 according to an example embodiment of the present invention. Detector assembly 10 may include a detector 12 and a detector base 14. Detector 12 may be configured to detect smoke, CO, $CO_2$, heat, and/or any other substance or environmental condition. Detector base 14 may be configured to provide audio, communication, networking, control, auxiliary sensing functionality, and/or any other types of functionality to the detector 12.

Figure 1B:
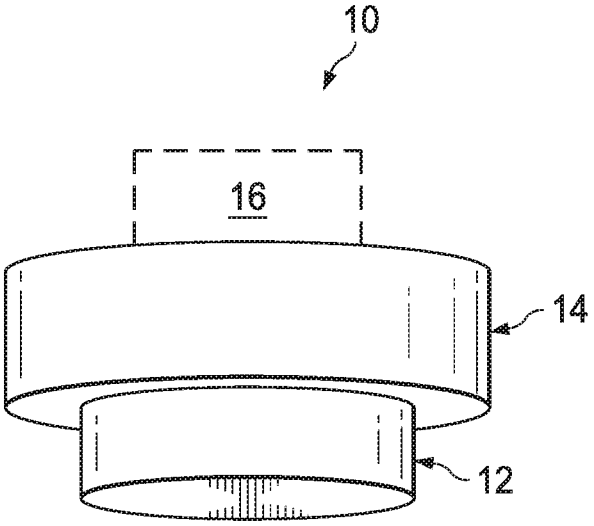
FIG. 1B shows an assembled view of the detector assembly of FIG. 1A.

FIG. 1B shows an assembled view of detector assembly 10 according to an example embodiment. As shown, detector base 14 may be mounted to junction box/mounting interface 16, and detector 12 may be mounted to detector base 14, e.g., in a piggy-back manner.

Figure 2A:
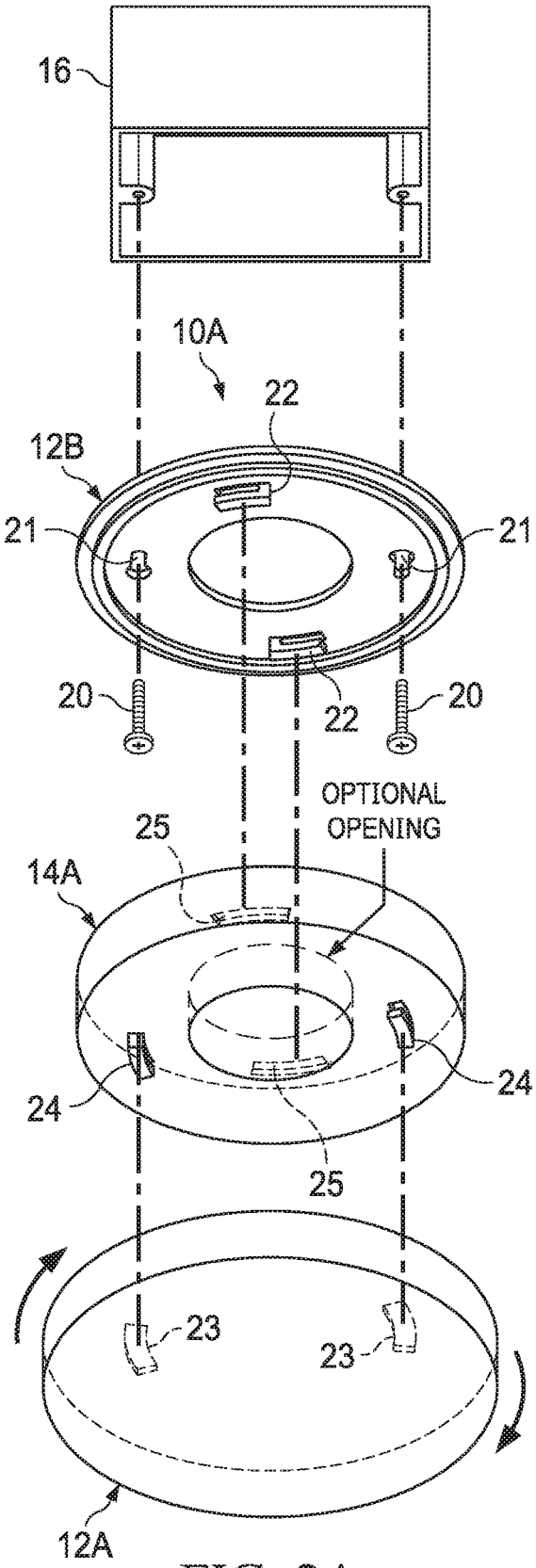
FIGS. 2A-2C illustrate example configurations of a detector assembly including a detector (e.g., smoke detector) and a detector base (e.g., for providing enhanced audio and/or control functionality for the detector), according to example embodiments of the present invention.
Figure 2B:
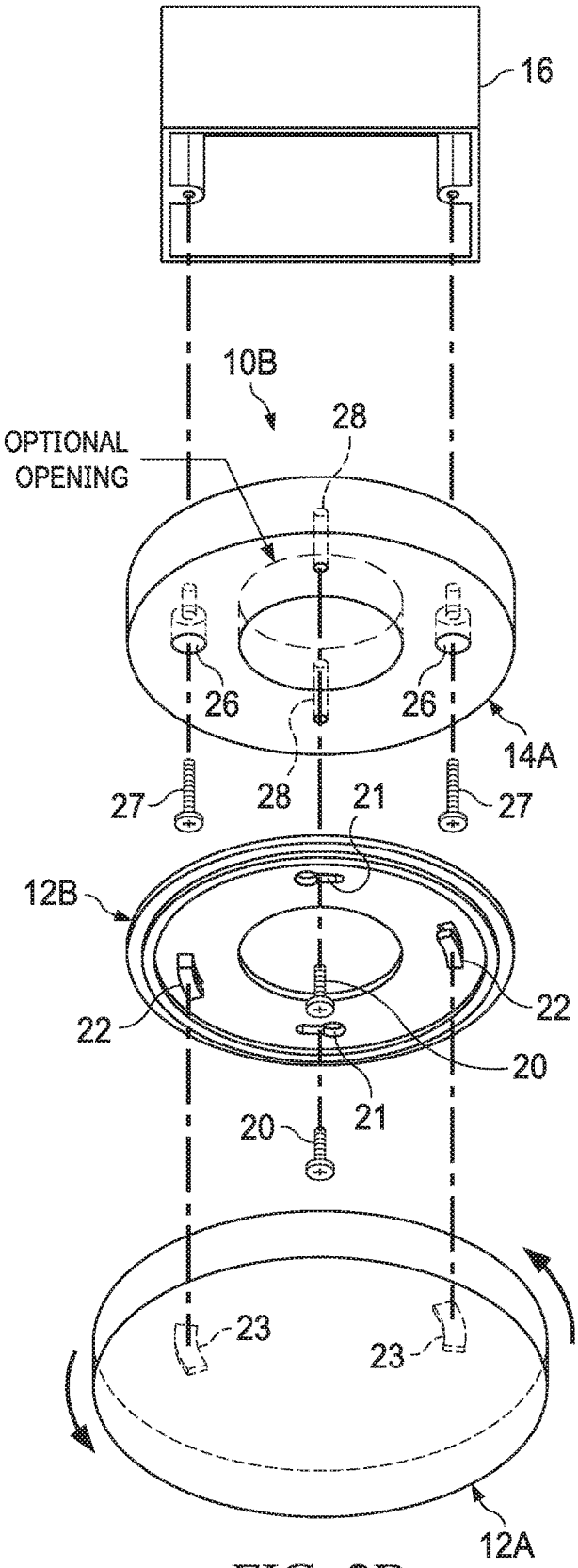
Figure 2C:
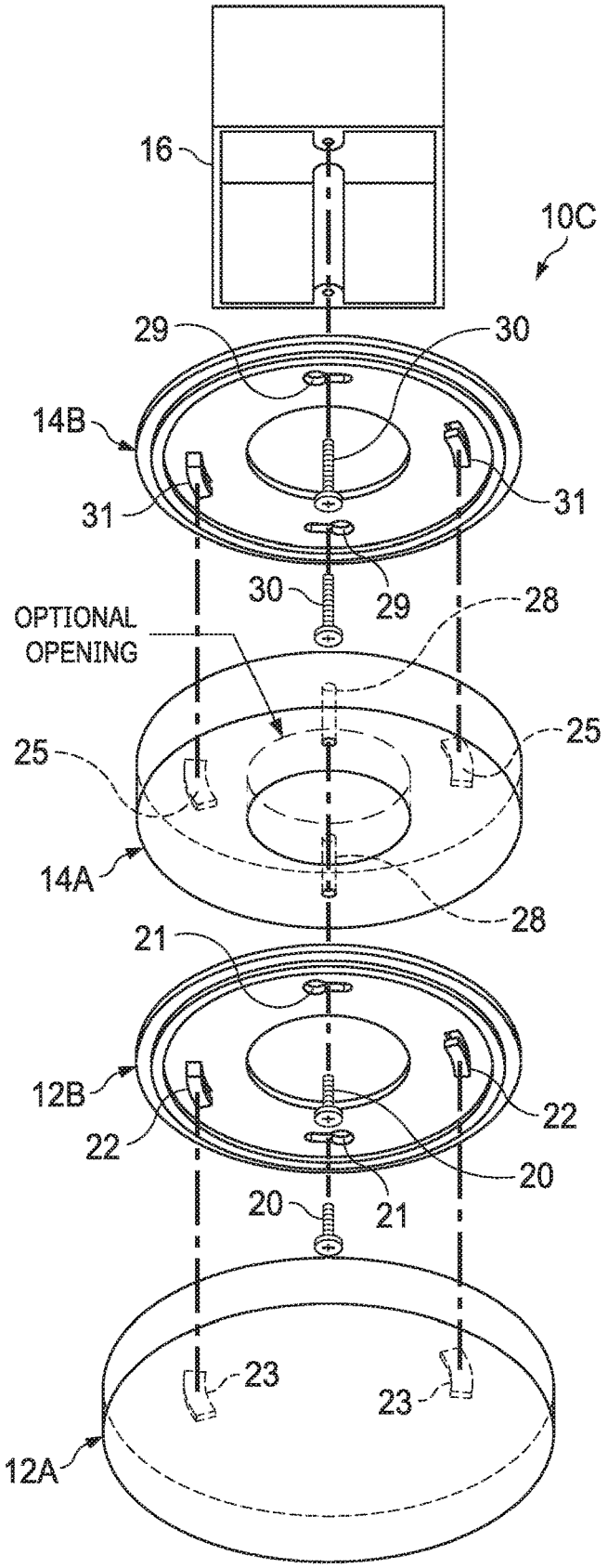

FIGS. 2A-2C illustrate three example configurations of detector assembly 10, indicated as detector assembly 10A, 10B, and 10C, according to example embodiments of the present invention. In each embodiment shown in FIGS. 2A-2C, a detector base 14 is assembled with a two-part detector 12 that includes a detector body 12A (housing the detector sensor(s) and electronics) and a separate detector mounting component 12B (e.g., a mounting plate or bracket). In a conventional use of the two-part detector 12, i.e., without the use of a detector base 14 as disclosed herein, detector mounting component 12B is configured for direct mounting to an electrical junction box or other mounting interface 16 (referred to herein as junction box 16 for convenience), and the detector body 12A is configured for mounting to the mounting component 12B. For example, detector mounting component 12B may include openings 21 for using screws or bolts 20 to secure detector mounting component 12B to junction box 16; and detector mounting component 12B and detector body 12A may include corresponding mounting structures, e.g., clips/flanges/grooves 22 and 23 that provide a quick-twist connection or other type of coupling to secure detector body 12A to detector mounting component 12B.

FIG. 2A shows an example assembly 10A in which detector base 14 is embodied as a single-piece device having a detector base body 14A that houses the components of detector base 14. In this embodiment, detector base body 14A is configured for assembly between detector body 12A and detector mounting component 12B, with detector mounting component 12B being mounted to junction box 16. Detector base body 14 may include (a) mounting structure(s) 25 at a first (e.g., top) side for coupling with mounting structure(s) 22 provide on detector mounting component 12B and (b) mounting structure(s) 24 at a second (e.g., bottom) side configured for coupling with mounting structure(s) 23 provided on detector base 12A. In some embodiments, mounting structure(s) 25 of detector base body 14A may mimic mounting structure(s) 23 of detector body 12A, and mounting structure(s) 24 of detector base body 14A may mimic mounting structure(s) 22 of detector mounting component 12B, to allow detector base body 14A to be conveniently assembly between detector body 12A and detector mounting component 12B.

FIG. 2B shows another example assembly 10B in which detector base 14 is embodied as a single-piece device having a detector base body 14A that houses the components of detector base 14. In this embodiment, detector base body 14A is configured to be mounted to junction box 16, with both parts 12A and 12B of a two-part detector 12 being assembled on the other side of detector base body 14A. Detector base body 14A may include any suitable mounting structures for the assembly configuration. For example, detector base body 14 may include (a) openings 26 configured for receiving screws or bolts 27 for mounting detector base body 14A to junction box 16, and (b) threaded openings 28 for receiving screws or bolts 20 for mounting detector mounting component 12B detector base body 14A. Threaded openings 28 may mimic (e.g., in size, spacing, threading, etc.) threaded openings in junction box 16, to correspond with openings 21 and threaded fasteners 20 that are designed for mounting detector mounting component 12B to junction box 16 (in a conventional mounting arrangement).

FIG. 2C shows another example assembly 10C in which detector base 14 is embodied as a two-part assembly including a detector base body 14A (housing the components of detector base 14) and a detector base mounting component 14B (e.g., a mounting plate or bracket). Detector base mounting component 14B may be configured for mounting to junction box 16, and detector base body 14A may be configured for mounting to detector base mounting component 14B and further configured for mounting a detector 12 (e.g., a two-part detector 12) to the detector base body 14A.

In the illustrated example, detector base mounting component 14B may include openings 29 for using screws or bolts 28 to secure detector base mounting component 14B to junction box 16; and detector base mounting component 14B and detector base body 14A may include corresponding mounting structures, e.g., clips/flanges/grooves 25 and 30 that provide a quick-twist connection or other type of coupling to secure detector base body 14A to detector base mounting component 14B. Detector base body 14A may include any mounting structures for mounting detector 12 to detector base body 14A. For example, detector base body 14 may include threaded openings 28 for receiving screws or bolts 20 for mounting detector mounting component 12B detector base body 14A. Threaded openings 28 may mimic (e.g., in size, spacing, threading, etc.) threaded openings in junction box 16. Detector mounting component 12B and detector body 12A may include corresponding mounting structures, e.g., clips/flanges/grooves 22 and 23 that provide a quick-twist connection or other type of coupling to secure detector body 12A to detector mounting component 12B.

In other embodiments or implementations, detector base 14 may be configured for assembly with a single-piece detector 12. For example, a single-piece or two-piece detector base 14 may be configured for assembly between a single-piece detector 12 and a junction box 16, using any of the various connections disclosed herein.

Mounting structures and/or connectors 20-31 discussed herein may each include any type of physical mounting structure or structures, including, for example: flexible clips or other connectors for a click-in or snap-type connection; threaded connectors for securing any respective components to each other; screws or other threaded fasteners and corresponding threaded openings; or any type of fasteners, connectors or other mounting structures.

Referring again to FIG. 1A, detector base 14 may also include one or more wired connection interfaces 19 for connection to one or more corresponding wired connection interfaces 18 provided by or routed through junction box/mounting interface 16. Wired connection interfaces 18 and 19 may include any type or types of wiring, cables, and connectors for communicating power, data, or other electrical signaling, including for example, (a) power cable(s) and/or connectors for connection to the electrical grid or other power source, (b) data communication cable(s) and/or connectors for providing a communication interface according to any one or more communication protocols (e.g., one or more Ethernet, Cat 5, or other twisted pair (UTP), coaxial cable, USB cable, audio cable, optical cable, HDMI cable, etc.), and/or (c) any other type of wiring, cables, or connectors for communicating power, data, or other electrical signaling from or through mounting interface 16 to detector base 14. Wired connection interfaces 18 and 19 may include any type or types of electrical connectors, e.g., any suitable male or female clips, plugs, jacks, sockets, posts, wire connectors, other audio cable connectors (e.g., keyed or pinned connectors), terminals, banana connectors, crimp connectors, or any other type of connector(s).

Detector base 14 may include one or more wired connection interfaces 36 for connection to one or more corresponding wired connection interfaces 42 provided by detector 12, e.g., to act as a pass-through for power and/or data between junction box 16 and detector 12 and/or to provide communications between detector base 14 and detector 12. As shown, detector base 14 may include pass-through wires, cables, or connections 38 to pass-through power (e.g., A/C mains power) and/or data between junction box 16 and detector 12.

Some existing types of detectors are configured to be networked together (e.g., to define a connected network of detectors at different locations in a residence or other building) via a ground wire (e.g., ground wire of a 3-wire Romex cable) or other wire connected between the group of detectors. Thus, in addition to passing A/C power from junction box 16 to detector 12, pass-through wiring/connections 38 of detector base 14 may include wiring/connections for passing-through an inter-detector networking line to the detector 12, e.g., via the ground wire of a 3-wire Romex or via a separate networking cable.

The example shown in FIG. 1A shows three different types of routing connections for routing power and/or data to or from junction box 16, in order from right-to left in FIG. 1A:

- an A/C power connection from junction box 16 routed to both (a) a power supply module 130 provided in detector base 14 and (b) a power supply module 106 provided in detector 12 (which may also include a ground wire for inter-detector networking as discussed above);
- a data connection to/from junction box 16 routed to both (a) a logic device/controller 110 provided in detector base 14 and (b) a logic device/controller 105 provided in detector 12; and
- a second connection (e.g., LAN connection) to/from junction box 16 and routed to logic device/controller 110 of detector base 14 via a wired transceiver 114 provided in detector base 14.

Any or all of these types of connections and/or any other suitable types of connection may be provided in various different embodiments of the present invention. The example components of detector base 14 and detector 12 mentioned above (power supply module 130, power supply module 106, logic device/controller 110, logic device/controller 105, and wired transceiver 114) are shown in FIG. 2, discussed below.

In addition, detector 12 may also include one or more wired connection interfaces 42 for connection to one or more corresponding wired connection interfaces 36 provided by detector base 14.

Wired connection interfaces 36 and 42 for connection of detector 12 to detector base 14 may be the same or similar as wired connection interfaces 18 and 19 between junction box/mounting interface 16 and detector base 14. Thus, wired connection interfaces 36 and 42 may include any of the type or types of wiring, cables, and connectors for communicating power, data, or other electrical signaling as discussed above with respect to wired connection interfaces 18 and 19. In other embodiments, detector 12 may only be configured for a subset of connections provided at or via junction box/mounting interface 16, and thus wired connection interfaces 36 and 42 between detector 12 and base 14 may include only a subset of the connections between base 14 and junction box 16. For example, detector 12 may be configured for power connection but not data communications via junction box 16, and thus may only include a single connection interface 42 for providing power to detector 12, whereas detector base 14 may be configured to send/receive data communications via junction box 16 using suitable wired connection interfaces 18 and 19.

In some embodiments or situations, detector assembly 10 may avoid technically difficult and/or expensive agency qualifications by using the auxiliary detector base 14 that provides various required or desired functionality and may fits the form factor to occupy the valuable ceiling, line-powered real estate. As discussed above, detector 12 may plug into or otherwise connect to the base 14 in a piggy-back manner.

Thus, in view of the above, detector body 12A may be selectively (a) mounted and electrically connected to detector base 14, or (b) directly mounted and electrically connected to junction box 16 according to a conventional mounting arrangement (without detector base 14).

Figure 3:
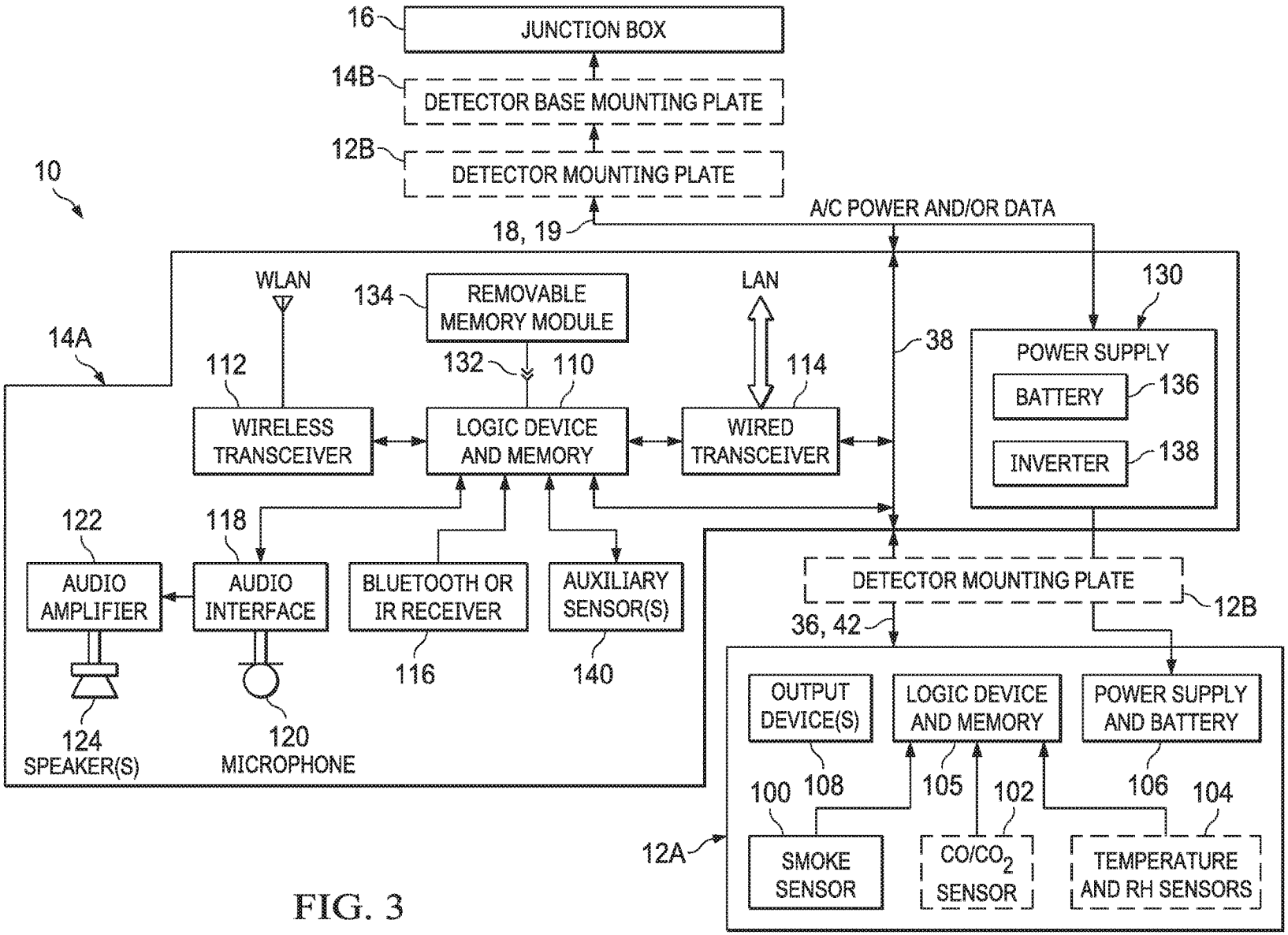
FIG. 3 is a block diagram showing example components of the example detector and detector base of the example detector assembly shown in FIGS. 1A and 1B, according to one example embodiment.

FIG. 3 shows a schematic block diagram of an example smoke detector assembly 10 including a detector 12 and a detector base 14, e.g., for providing enhanced functionality (e.g., enhanced audio, communications, and/or sensing capabilities), according to example embodiments of the invention. More particularly, assembly 10 may include a detector body 12A, a detector mounting component (e.g., mounting plate) 12B, a detector base body 14A, and (optionally) a detector base mounting component (e.g., mounting plate) 14B. Detector mounting component 12B and/or detector base mounting component 14B may be arranged at various locations in the assembly based on the particular configuration or embodiment, e.g., as shown in FIGS. 2A-2C discussed above.

Detector 12 may include a smoke sensor 100, carbon monoxide and/or carbon dioxide sensor(s) 102, temperature and/or relative humidity (RH) sensor(s) 104, and/or any other sensor(s) for detecting any type of substance or environmental condition. Detector 12 may also include a logic device 105 having an associated memory, a power supply 106 with battery backup, and one or more output devices 108 (e.g., a speaker, LEDs and/or other visual, audible, or haptic output device) for outputting alarms or notifications. Smoke sensor 100 may be an ionization and/or optical smoke sensor, and the like. Sensor(s) 102 may include a carbon monoxide and/or carbon dioxide sensor(s), and/or sensor(s) for detecting explosive gas, hazardous gas, and/or heat. Temperature and/or relative humidity sensor(s) 104 may be used to provide local sensing and control for heating, ventilation and cooling (HVAC) equipment, and/or indoor air quality (IAQ), e.g., whole house dehumidification using the relative humidity sensor 104, and/or fresh air ventilation control using the carbon dioxide sensor 102, for example.

Detector base 14 may include a logic device 110 having an associated memory, a wireless transceiver 112 coupled to an antenna and/or a wired transceiver 114 coupled to a wired local area network (LAN), a Bluetooth and/or an infrared (IR) receiver 116, an audio interface 118, a microphone 120, an audio amplifier 122, a speaker(s) 124, a power supply system 130 with battery backup, a memory device port 132 for receiving a removable memory device 134, and in some embodiments, at least one auxiliary sensor 140.

Logic device 110 may comprise mixed signal (analog and digital) capabilities, one or more programs, and storage memory. In some embodiments, logic device 110 may comprise an application specific integrated circuit (ASIC), a programmable logic array, a microcontroller, a microprocessor, or a digital signal processor (DSP), and may have both digital and analog capabilities. Wireless transceiver 112 and/or wired transceiver 114 may be part of or separate from logic device 110.

Power supply system 130 of detector base 14 may be configured to supply power to the various components of detector base 14, and also to detector 12, e.g., as a redundant power source for detector 12. Power supply system 130 may be configured to supply power from an AC mains (e.g., via junction box 16) to the components of detector base 14, e.g., directly as A/C power or after conversion to DC by an ADC provided in power supply system 130. Detector base power supply system 130 may include a battery 136 for providing power (either as a primary or back-up power source) to detector base 14 and/or to detector 12. In some embodiments, power supply system 130 may also include an invertor 138 configured to convert power from battery 136 to A/C, and supply the A/C power to detector 120, e.g., for an A/C-powered detector 120.

Detector base 14 may provide an audio interface that allows for either half or full duplex operation with the microphone 120 and the audio amplifier 122/speaker 124. In addition, audio content, e.g., music and/or voice content, may be communicated to logic device 110 via wired transceiver 114, wireless transceiver 112, Bluetooth receiver 116, and/or any other wired or wireless interface provided by detector base 14. Simplex (one way) or duplex (two way) communications may be used for communications with another networked detectors assembly 10, a speaker/microphone at a entrance door (doorbell interface), and/or a telephone line for speakerphone operation. Music and/or audio may be amplified by the audio amplifier 122 and output from speaker(s) 124 to occupant(s) of an area proximate to the detector assembly 10. Audio (voice) from occupant(s) proximate to the detector assembly 10 may be picked up by microphone 120 and communicated to logic device 110 via audio interface 118. Audio interface 118 may also provide duplex operation of a voice conversation between two detector assemblies 10, a detector assembly 10 and a doorbell communications interface (not shown), and/or a telephone, for example.

Memory device port 132 provided in detector base 14 may be configured to receive a removable memory device 134, e.g., USB thumb drive, secure digital (SD) drive, etc. The removable memory device 134 may remain in place with its associated detector assembly 10 (i.e., with its associated detector 12) or may download its contents into a memory (e.g., memory of logic device 110) and then be removed. In example embodiments, the removable memory device 134 may store preprogrammed alarm announcements (e.g., for one or more different types of detected alarm conditions) and/or preprogrammed music or other audio content (e.g., white noise, lullaby's, poetry, exercise routines, etc.,) for output via speaker 124 at requested and/or preprogrammed times.

Detector base 14 may include one or more sensors 140 to provide auxiliary sensing functionality to detector 12. Sensor(s) 140 may include, for example a smoke detector, a CO detector, a $CO_2$ sensor, a sensor for sensing any other gas(es), a heat sensor, a humidity sensor, a motion sensor, and/or any other type(s) of sensor(s). In some embodiments, sensor(s) 140 provided in detector base 14 may include (a) one or more of the same type(s) of sensor(s) as provided in detector 12, e.g., to provide back-up redundancy or further analysis for the relevant type(s) of detection, and/or (b) one or more types of sensors that are not provided in detector 14, e.g., to provide additional detection functionality to the detector. For example, in a configuration in which detector 12 includes a smoke sensor 100, detector base sensor(s) 140 may include at least one other type of sensor not provided in detector 12 and also (optionally) a secondary or redundant smoke detector. As another example, where detector 12 includes a smoke sensor 100, a $CO/CO_2$ sensor 102, and a temperature/heat sensor 104, detector base sensor(s) 140 may include may include at least one other type of sensor not provided in detector 12, and may also (optionally) include one, two, or all three of the types of sensors provided in detector 12 (i.e., sensors 100, 102, and/or 104)

In operation, logic device 105 of detector 102 may be configured to receive signals from sensors 100, 102, and 104, determine one or more types of alarm condition based on such sensor signals (e.g., smoke alarm condition, carbon monoxide/dioxide alarm condition, or other hazardous condition), generate an alarm, and controlling a speaker or other output device(s) 108 to output an audible alarm notification. In arrangements in which detector 102 is networked with other detectors (e.g., via a ground wire or other network links), logic device 105 may also communicate signal other networked detectors of a detected alarm condition (e.g., to meet building code requirements), by a code approved wired communications line, e.g., Ethernet LAN, etc. (via a pass-through/jumper connection 38), or by wireless signaling over a code approved WLAN, WiFi, etc., signal using a wireless transceiver provided in detector 102. In some configurations, logic device 105 may communicate signals to other networked detectors by pulling down a voltage on a ground wire connected between the detectors or otherwise signaling over a ground wire or other wiring connected between the networked detectors (via a pass-through/jumper connection 38).

In addition, in some embodiments, detector base 14 (via program logic of logic device 110) may be configured to detect network signaling from detector 12 by monitoring pass-through connection(s) 38 (e.g., by monitoring voltage, current, or inductance), and may add further signaling (via wired or wireless communications), audio output, alert recording/archiving, or other functionality associated with alerts generated by detector 102. Further, in one embodiments, microphone 120 of detector base 14 may detect audio alarms output by a speaker 108 of detector 102, and program logic of logic device 110 may identify the alarm (and in some configurations, the type of alarm) and provide any of the additional functionality discussed above.

Figure 4:
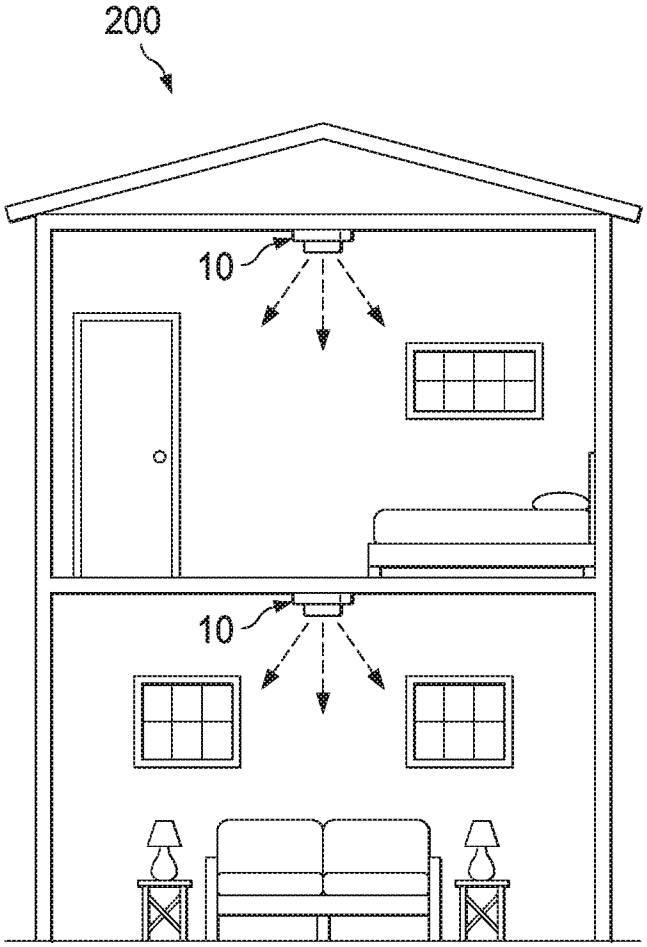
FIG. 4 illustrates a schematic elevational diagram of smoke detector assemblies with enhanced audio and communications capabilities in a dwelling, according to an example embodiment.

FIG. 4 shows a simplified representation of example detector assemblies 10 having enhanced audio and communications capabilities in a dwelling 200, according to a specific example embodiment of this disclosure. Each detector assembly 10 may correspond with any of the example detector assemblies 10 shown in FIGS. 1-3 and discussed above, or may be a variant thereof. A detector assembly 10 may be mounted in each room of the dwelling 200, e.g., as required by a relevant building code. Electrical power may be supplied to each detector assembly 10 and a wired communications bus (e.g., Ethernet local area network (LAN) cabling, etc.) or a code approved wireless communications link (e.g., WLAN, WiFi, Zigbee, etc.) may be used to communicate alarm actuation, e.g., as required by a relevant building code, and communicate audio (e.g., music, intercom voice paging, doorbell annunciation, etc.) to a speaker provided in a detector base of each detector assembly 10. A detector base 14 of each detector assembly 10 may also provide audio evacuation instructions that may be prerecorded or live audio from a fire or building official. Prerecorded instructions and/or audio content may also be stored in a removable memory device 134 of each respective detector base 14.

Figure 5:
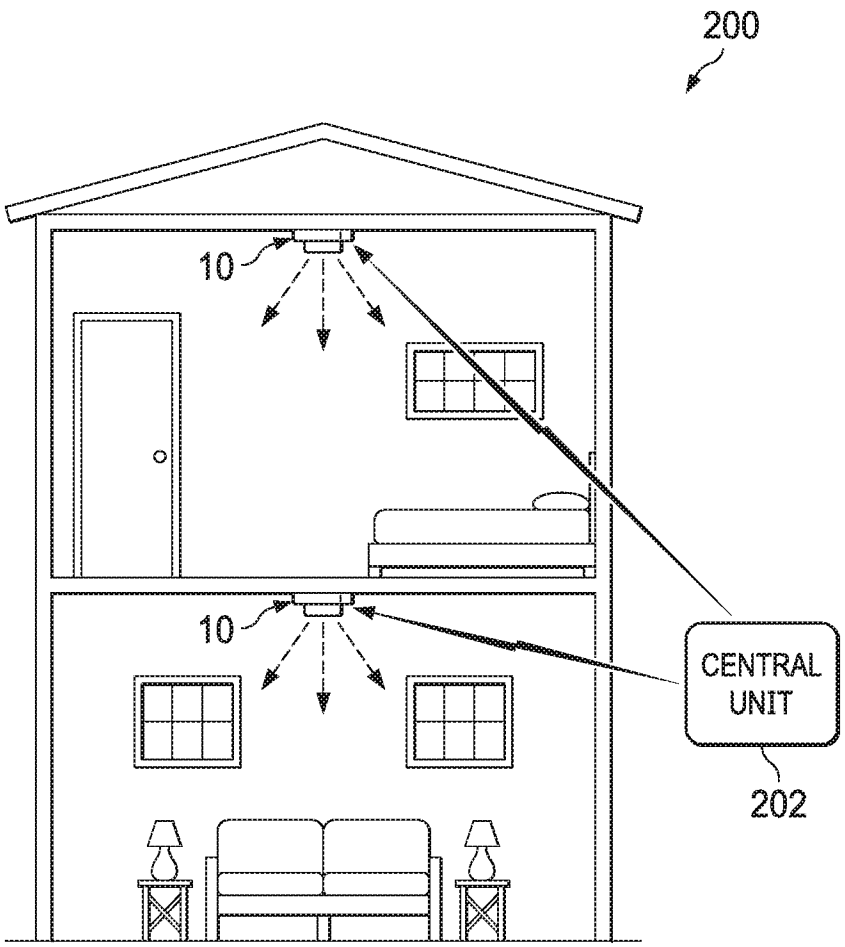
FIG. 5 illustrates a schematic elevational diagram of smoke detector assemblies with enhanced audio and communications capabilities in a dwelling that may be controlled by a control unit, according to another example embodiment.

FIG. 5 shows a simplified representation of example detector assemblies 10 that may be controlled by a control unit 202, according to an example embodiment of the invention. Each detector assembly 10 may correspond with any of the example detector assemblies 10 shown in FIGS. 1-3 and discussed above, or may be a variant thereof. The control unit 202 may be, for example, a personal computer, digital disc player (e.g., CD, DVD, Blu-ray, etc.), tablet computer, home entertainment system, etc., and may provide audio content to the detector base 14 of each detector assembly 10. The control unit 202 may provide different and customized audio content to each detector base 14. The control unit 202 may be hardwired, e.g., communication and signal cable (e.g., twisted pairs), or connected wirelessly, e.g., WLAN, WiFi, etc., to each detector assembly 10. The detector base 14 of each detector assembly 10 may also provide audio evacuation instructions that may be prerecorded in the control unit 202 or live audio from a fire or building official. Prerecorded instructions and/or audio content may also be stored in a removable memory device 134 of each respective detector base 14.

Figure 6:
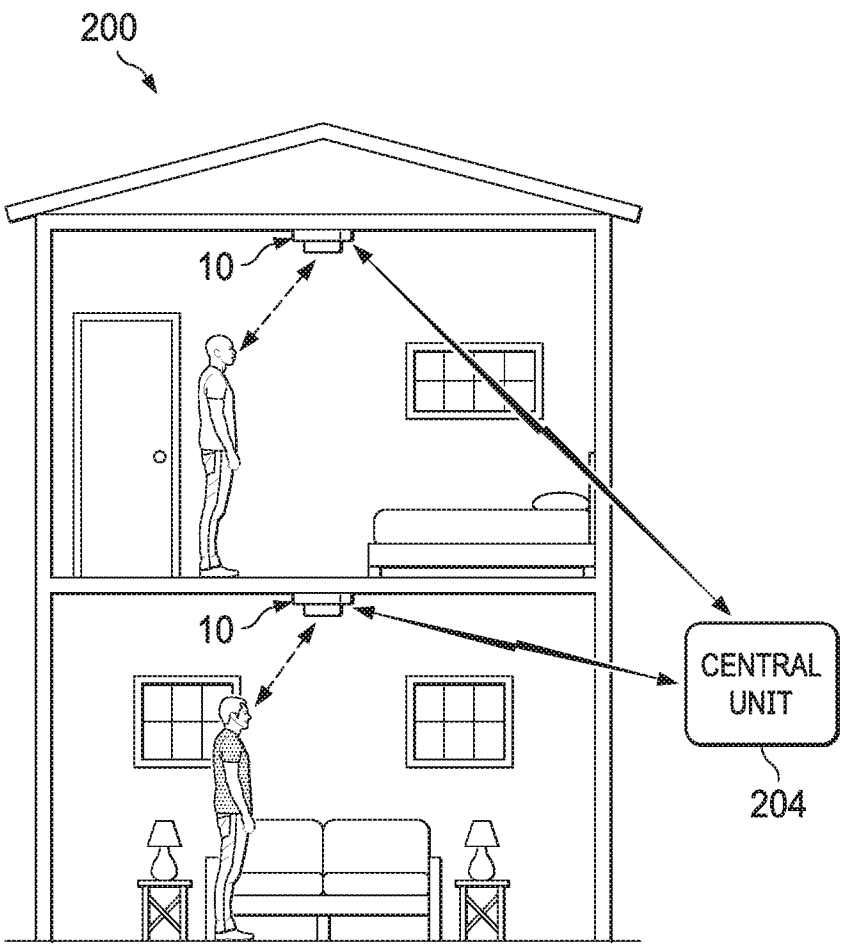
FIG. 6 illustrates a schematic elevational diagram of smoke detector assemblies with enhanced audio and two-way communications capabilities in a dwelling that may be controlled by a control unit, according to yet another example embodiment.

FIG. 6 shows a simplified representation of example detector assemblies 10 having enhanced audio functionality and two-way communications capabilities, which may be controlled by a control unit 204, according to another example embodiment. Each detector assembly 10 may correspond with any of the example detector assemblies 10 shown in FIGS. 1-3 and discussed above, or may be a variant thereof. The control unit 204 may be embodied in a personal computer, tablet computer, home entertainment system, etc., may provide audio content to, from and/or between each detector assembly 10, e.g., paging or intercom between detector assemblies 10, telephone answering and talking, communications with doorbell located speaker/microphone (not shown), etc. Voice commands may be utilized to the answer the telephone or initiate and dial a telephone call. Voice commands may also be utilized to initiate communications with a person at the doorbell location and even unlock the door upon a coded command. Voice commands via a detector assembly 10 and control unit 204 may also be used to control lights and/or an HVAC system. Messages may be recorded and stored in the control unit 204 for providing audio evacuation instructions during a smoke alarm event, for example. Further, prerecorded instructions and/or audio content may also be stored in a removable memory device 134 in each detector base 14.

Figure 7:
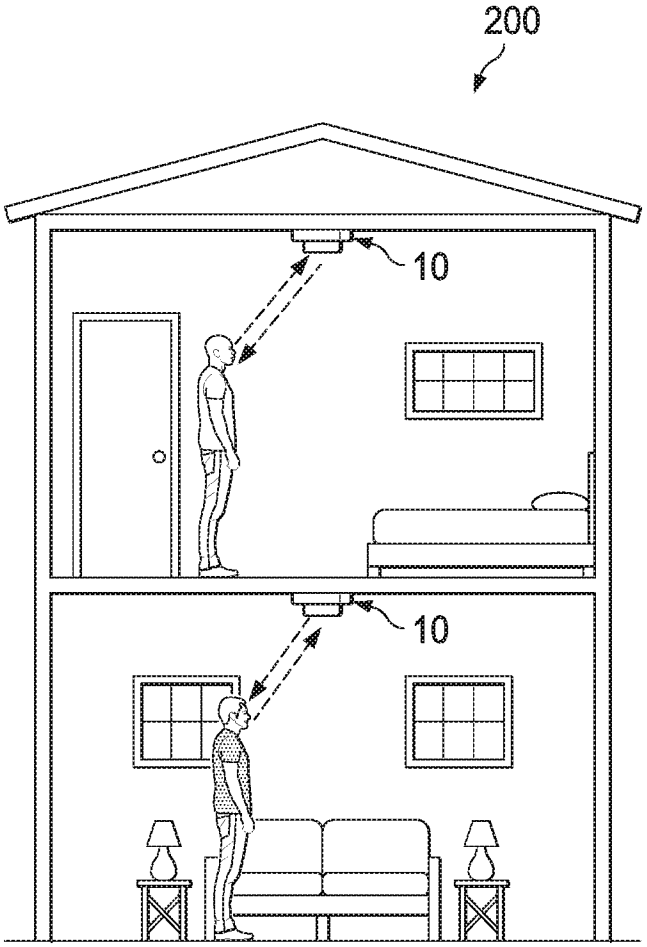
FIG. 7 illustrates a schematic elevational diagram of smoke detector assemblies with enhanced audio and two-way communications capabilities in a dwelling, according to still another example embodiment.

FIG. 7 shows a simplified representation of example detector assemblies 10 having enhanced audio functionality and two-way communications capabilities, according to another example embodiment of this disclosure. Each detector assembly 10 may correspond with any of the example detector assemblies 10 shown in FIGS. 1-3 and discussed above, or may be a variant thereof. Each detector assembly 10 may provide audio content to, from and/or between other detector assemblies 10, e.g., to provide a paging or intercom function between detector assemblies 10. Messages may be recorded and stored in each detector assembly 10 for providing audio evacuation instructions during a smoke alarm event, for example. Further, prerecorded instructions and/or audio content may also be stored in a removable memory device 134 in each detector base 14.

Figure 8:
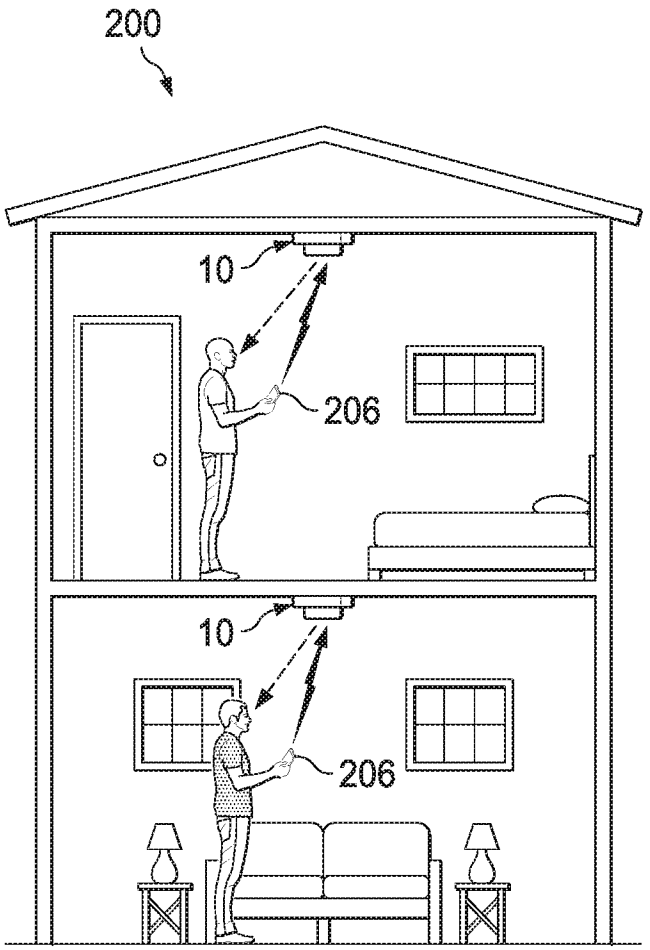
FIG. 8 illustrates a schematic elevational diagram of smoke detector assemblies with enhanced audio and two-way communications capabilities in a dwelling that may be controlled with local control units, according to another example embodiment.

FIG. 8 shows a simplified representation of example detector assemblies 10 having enhanced audio functionality and two-way communications capabilities, which may be controlled with local control units, according to another example embodiment of the invention. Each detector assembly 10 may correspond with any of the example detector assemblies 10 shown in FIGS. 1-3 and discussed above, or may be a variant thereof. A local handheld wireless controller 206, e.g., smart phones or other handheld device may be configured to control the operation of each detector assembly 10 (via the respective detector base 14) via WiFi, Bluetooth, infrared (IR), or any other short-distance communication protocol, for providing music content, paging, intercom functions, telephone answering and talking, doorbell communications, or any other audio functionality. In some embodiments, a music, voice, doorbell, and/or telephone interface may be used to facilitate such functions with detector assemblies 10 via wired (e.g., Ethernet LAN, etc.) and/or wireless (e.g., WiFi, WLAN, etc.) communications. Messages may be recorded and stored in each smoke detector assembly 10 for providing audio evacuation instructions during a smoke alarm event, for example. Prerecorded instructions and/or audio content may also be stored in a removable memory device 134 in each detector base 14.

Figure 9:
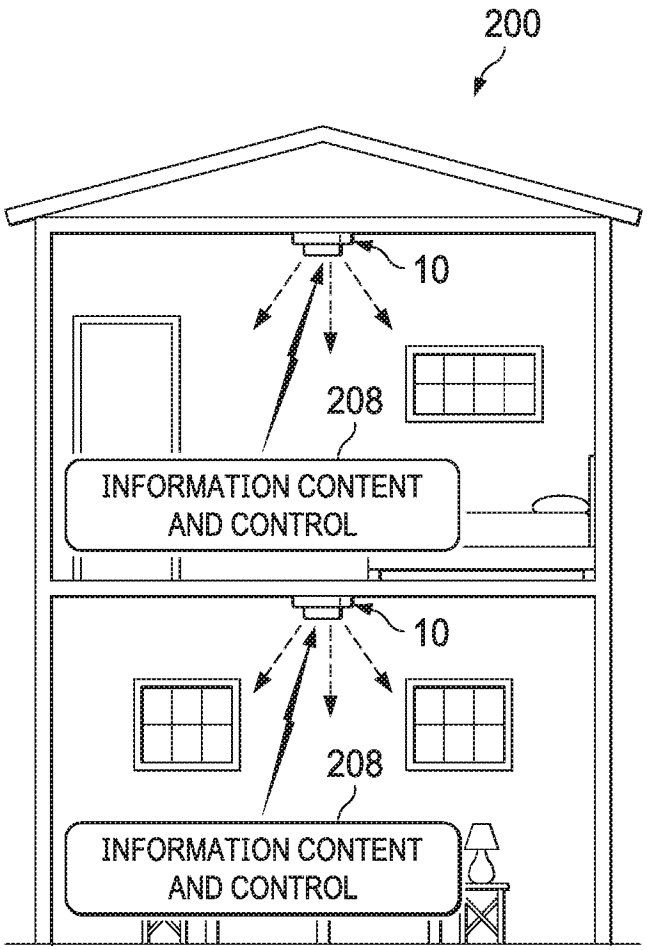
FIG. 9 illustrates a schematic elevational diagram of smoke detector assemblies with enhanced audio and communications capabilities in a dwelling that may be locally controlled for information and content, according to another example embodiment While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

FIG. 9 shows a simplified representation of example detector assemblies 10 that may be locally controlled for information and content, according to another example embodiment of the invention. Each detector assembly 10 may correspond with any of the example detector assemblies 10 shown in FIGS. 1-3 and discussed above, or may be a variant thereof. A local information and control unit 208, e.g., personal computer, touch pad tablet computer, smart cell phone, clock radio, etc., may be used proximate each detector assembly 10 for providing information content and control thereto. Control and communications from the local information and control unit 208 may be through wired or wireless communications, e.g., Bluetooth, Ethernet LAN, WLAN, WiFi, etc. The local information and control units 208 may provide music and/or voice to respective detector assemblies from radio stations, recordings, Internet, etc. Detectors assemblies 10 may also provide audio evacuation instructions that may be prerecorded in the local information and control unit 208 or live audio from a fire or building official. Further, prerecorded instructions and/or audio content may also be stored in a removable memory device 134 in each detector base 14.

The present disclosure has been described in terms of one or more embodiments, and it should be appreciated that many equivalents, alternatives, variations, and modifications, aside from those expressly stated, are possible and within the scope of the disclosure. While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein.

The invention claimed is:

1. A detector assembly, comprising:

a detector configured to be mounted to a junction box or other detector mounting interface, the detector comprising:

a detector housing;

a plurality of different types of sensors arranged in the detector housing, each configured to detect at least one substance or environmental condition associated with one of a plurality of different types of alert conditions;

a detector logic device configured, for each different type of sensor, to identify the type of alert condition corresponding with the respective type of sensor based on sensor signals generated by the respective sensor, and output an alert signal associated with the identified type of alert condition; and a speaker or other output device configured to output a human-perceptible alert notification based on the alert signal generated by the detector logic device; and an add-on detector base configured to be mounted between the detector and the junction box or other detector mounting interface, the add-on detector base comprising:

a detector base housing separate and distinct from the detector housing;

a first detector base mounting structure configured for mounting the add-on detector base to the junction box or other detector mounting interface;

a second detector base mounting structure configured for mounting the detector to the add-on detector base;

an auxiliary function system including a detector base logic device;

a signaling connection between the detector base logic device of the auxiliary function system and the detector logic device of the detector for receiving the alert signal output by the detector logic device at the auxiliary function system;

wherein the auxiliary function system is configured to:

receive, via the signaling connection, the alert signal output by the detector logic device;

detect the alert signal output by the detector logic device;

identify a type of alert condition from the plurality of different types of alert conditions based on the detected alert signal; and provide at least one audio, communication, or data recording function corresponding to the identified type of alert condition;

such that the detector assembly including the detector and the add-on detector base is configured to both (a) output, by the speaker or other output device of the detector, the human-perceptible alert notification based on the alert signal generated by the detector logic device and (b) provide, by the auxiliary function system of the detector base, the at least one audio, communication, or data recording function corresponding to the identified type of alert condition;

wherein the add-on detector base is a distinct and separate add-on device physically mounted to the detector.

2. The detector assembly of claim 1, wherein:

the detector includes a detector mounting plate configured for mounting the detector housing to the junction box or other detector mounting interface; and the add-on detector base is configured to be mounted between the detector mounting plate and the detector housing.

3. The detector assembly of claim 1, wherein:

the detector includes a detector mounting plate configured for mounting the detector housing to the junction box or other detector mounting interface; and the add-on detector base is configured to be mounted between the detector mounting plate and the junction box or other detector mounting interface.

4. The detector assembly of claim 1, wherein the add-on detector base comprises conductive elements for transferring power from a power source to the detector.

5. The detector assembly of claim 1, wherein the add-on detector base comprises an audio system including a speaker configured to output voice-based audio.

6. The detector assembly of claim 5, wherein the audio system of the add-on detector base is configured to output audio content during a time at which no alert condition is detected by the detector.

7. The detector assembly of claim 1, wherein the at least one sensor of the detector comprises at least one of a smoke sensor, a carbon monoxide sensor, a carbon dioxide sensor, or a heat sensor.

8. The detector assembly of claim 1, wherein the add-on detector base comprises a microphone, and wherein the detector base logic device is configured to:

analyze sound signals received by the microphone; and identify the type of alert condition from the plurality of different types of alert conditions based on the analyzed sound signals.

9. The detector assembly of claim 1, wherein:

the add-on detector base includes a local area network (LAN) communications interface coupled to the detector base logic device, wherein the LAN communications interface is coupled to a wired communications bus or to a wireless communication interface coupled to a wireless antenna; and the add-on detector base is configured to receive audio content communication via the LAN communications interface, and output the audio content via the speaker during a time at which no alert condition is detected by the detector.

10. The detector assembly of claim 1, wherein the add-on detector base is configured to output voice-based audio corresponding to the identified type of alert condition via a speaker provided by the add-on detector base.

11. The detector assembly of claim 1, wherein:

the add-on detector base comprises a microphone configured to detect sounds including an audible alert output by the detector based on the alert condition identified by the detector logic device; and the detector base logic device is configured to:

analyze sounds detected by the microphone;

identify, based on the analyzed sounds, the audible alert output by the detector; and provide at least one audio, communication, or data recording function in response to identifying the audible alert output by the detector.

12. The detector assembly of claim 1, wherein the auxiliary function system of the add-on detector base includes at least one sensor selected from the group consisting of a smoke sensor, a CO sensor, a $CO_2$ sensor, a sensor for sensing another gas, a heat sensor, a humidity sensor, and a motion sensor.

13. The detector assembly of claim 1, wherein the add-on detector base includes a battery configured to supply power to electronics of the add-on detector base and to supply power to electronics of the detector, to thereby act as a back-up or redundant power source to the electronics of the detector mounted to the add-on detector base.

14. An add-on detector base device for providing auxiliary functionality, including remote alerting functionality, to a detector device including a sensor configured to detect at least one substance or environmental condition and a detector logic device configured to identify an alert condition based on sensor signals generated by the sensor and output an alert signal, the add-on detector base device being a distinct add-on device for the detector device and comprising:

a detector base device housing;

a first detector base device mounting structure configured for mounting the add-on detector base device to a junction box or other detector mounting interface that is configured for direct mounting of the detector device;

a second detector base device mounting structure configured for mounting the detector device to the add-on detector base device;

a wired or wireless network connection to one or more remote add-on detector base devices physically mounted to one or more respective remote detector devices at one or more remote locations from the detector base device; and an auxiliary function system including a detector base device logic device and configured to:

receive or detect the alert signal output by the detector device mounted to the add-on detector base device; and in response to receiving or detecting the alert signal output by the detector device mounted to the add-on detector base device, communicate an alert notification via the wired or wireless network connection to the one or more remote add-on detector base devices physically mounted to the one or more respective remote detector devices to allow the one or more remote add-on detector base devices to output an alert at the one or more remote locations, such that the auxiliary function system of the add-on detector base device, physically mounted to the detector device as a distinct add-on device, provides remote, networked alerting functionality to the detector device.

15. The add-on detector base device of claim 14, wherein the auxiliary function system includes at least one sensor selected from the group consisting of a smoke sensor, a CO sensor, a $CO_2$ sensor, a sensor for sensing another gas, a heat sensor, a humidity sensor, and a motion sensor.

16. The add-on detector base device of claim 14, comprising a battery configured to supply power to electronics of the add-on detector base device and to supply power to electronics of the detector device, to thereby act as a back-up or redundant power source to both the electronics of the add-on detector base device and the electronics of the detector device.

17. The add-on detector base device of claim 14, wherein the wired or wireless network connection comprises a LAN or WLAN.

18. The add-on detector base device of claim 14, wherein:

the wired or wireless network connection comprises a ground wire connected between the add-on detector base device and the one or more other detector base devices; and communicating an alert notification to the one or more remote detector base devices physically mounted to the one or more respective remote detector devices comprises signaling by modifying a voltage on the ground wire.

19. The add-on detector base device of claim 14, wherein:

the auxiliary function system includes at least one sensor selected from the group consisting of a smoke sensor, a CO sensor, a $CO_2$ sensor, a sensor for sensing another gas, a heat sensor, a humidity sensor, and a motion sensor; and the detector base device logic device is configured to:

detect a sensor-based condition based on the at least one sensor of the auxiliary function system of the add-on detector base device; and in response to detecting the sensor-based condition, communicate an alert notification, via the wired or wireless network connection, to the one or more remote detector base devices physically mounted to the one or more respective remote detector devices at one or more remote locations than the detector base device for output of an auxiliary alert by the one or more remote detector base devices at the one or more remote locations.

20. An add-on detector base device for providing auxiliary functionality to a detector device including a sensor configured to detect at least one substance or environmental condition and a detector logic device configured to identify an alert condition based on sensor signals generated by the sensor and output an alert signal, wherein the add-on detector base device is a distinct and separate add-on device mountable to the detector device; and wherein the add-on detector base device comprises:

an add-on detector base device housing distinct and separate from a detector device housing of the detector device;

a first add-on detector base device mounting structure configured for mounting the detector base device to a junction box or other detector mounting interface that is configured for direct mounting of the detector device;

a second add-on detector base device mounting structure configured for mounting the detector device to the detector device;

an auxiliary function system including an add-on detector base device logic device and configured to provide at least one audio function, communication function, data recording function, or sensor-based detection function;

a battery provided in the add-on detector base device housing; and a first connection between the battery and the add-on detector base device electronics provided in the add-on detector base device housing, and a second connection between the battery and detector device electronics provided in the detector device housing that is distinct and separate from the add-on detector base device housing, such that the battery is configured to supply power to the add-on detector base device electronics in the add-on detector base device housing and configured to supply power to detector device electronics in the detector device housing, to thereby act as a back-up or redundant power source to the detector device electronics.

* * * * *